US006691690B2

(12) United States Patent
Shin

(10) Patent No.: US 6,691,690 B2
(45) Date of Patent: Feb. 17, 2004

(54) METHOD AND SYSTEM FOR PREVENTING REVERSE ROTATION OPERATION OF ENGINE

(75) Inventor: Hyun-Jin Shin, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/216,497

(22) Filed: Aug. 9, 2002

(65) Prior Publication Data

US 2003/0041847 A1 Mar. 6, 2003

(30) Foreign Application Priority Data

Aug. 31, 2001 (KR) ..... 2001-53502

(51) Int. Cl.[7] ..... F02P 11/00
(52) U.S. Cl. ..... 123/631; 123/406.62; 123/198 D
(58) Field of Search ..... 123/631, 479, 123/198 D, 198 DB, 198 DC, 406.62

(56) References Cited

U.S. PATENT DOCUMENTS 4,074,669 A * 2/1978 Cavil et al. ..... 123/631
4,491,121 A * 1/1985 Miura et al. ..... 123/631
5,622,153 A * 4/1997 Ott et al. ..... 123/631
6,016,789 A * 1/2000 Denz et al. ..... 123/406.62
6,035,826 A * 3/2000 Matsuoka ..... 123/406.62
6,578,550 B1 * 6/2003 Rupp et al. ..... 123/631

* cited by examiner

*Primary Examiner*—Erick Solis
(74) *Attorney, Agent, or Firm*—Pennie & Edmonds LLP

(57) ABSTRACT

The present invention relates to a method and system for preventing reverse rotation operation of an engine using a system that includes a crank angle sensor (CAS), a cam position sensor (CPS), and an engine control unit for receiving signals from the CAS and the CPS to perform engine control. The method includes determining if a piston in a specific cylinder is at a predetermined location using a level of a CPS signal at a leading edge and a trailing edge of a CAS signal; determining if the engine is rotating in reverse using the CPS signal level at the leading edge and trailing edge of the CAS signal in the case where it is determined that the piston of the specific cylinder is at the predetermined location; and discontinuing operation of the engine if it is determined that the engine is undergoing reverse rotation.

5 Claims, 3 Drawing Sheets

METHOD AND SYSTEM FOR PREVENTING REVERSE ROTATION OPERATION OF ENGINE

FIELD OF THE INVENTION

The present invention relates to a method and a system for preventing reverse rotation operation of an engine. More particularly, the present invention relates to a method for preventing reverse rotation operation of an engine in which a forward rotation and a reverse rotation of an engine are detected, and control is performed to prevent the reverse rotation of the engine such that damage to the same does not occur.

BACKGROUND OF THE INVENTION

When starting from a stopped state on a hill, a vehicle often reverses slightly before moving forward. This may be caused by the delayed operation of the accelerator pedal by the driver (or slow depressing of the accelerator pedal and releasing of the clutch pedal in a vehicle with a manual transmission) upon brake release, or it may result naturally as a result of the weight of the vehicle. When this occurs, the engine rotates in a direction opposite from the normal direction, that is, the engine rotates in reverse.

However, since a distinction between forward and reverse rotation of the engine is not made by the logic employed in typical present-day microprocessors used in vehicles, the RPM gauge in a cluster operates during both forward and reverse engine rotation. Further, during the reverse rotation of the engine, the engine control unit makes erroneous determinations based on normal vehicle operating condition logic and performs control to effect fuel injection. The engine control unit also performs malfunction diagnosis during the reverse rotation of the engine such that erroneous determinations of malfunctions occur. As a result, warning lights are illuminated when no malfunction exists.

With the use of such conventional control, logic control is performed identically regardless of whether the engine is undergoing forward or reverse rotation. Therefore, when the engine is rotating reversibly, it is determined that the vehicle is operating normally and control logic is performed in the normal manner. As a result, fuel injection is performed and other abnormal operations are effected. In extreme cases, the vehicle is propelled in the reverse direction. Also, it may be erroneously determined that the vehicle is malfunctioning.

SUMMARY OF THE INVENTION

The present invention provides a method for preventing reverse rotation operation of an engine. Forward rotation and reverse rotation of an engine are detected, and control is performed to prevent abnormal operation and the misdiagnosis of a malfunction during reverse rotation operation.

In a preferred embodiment of the present invention, a crank angle sensor (CAS), a cam position sensor (CPS), and an engine control unit receiving signals from the CAS and the CPS representative of the sensed parameters perform engine control according to a predetermined control program. The control program comprises determining if a piston in a specific cylinder is at a predetermined location using a level of the CPS signal at a leading edge and the trailing edge of the CAS signal, determining if the engine is rotating in reverse using the CPS signal level at the leading edge and trailing edge of the CAS signal in the case where it is determined that the piston of the specific cylinder is at the predetermined locations, and discontinuing operation of the engine if it is determined that the engine is undergoing reverse rotation.

Preferably, it is determined that the piston in the specific cylinder is at the predetermined position if the level of the CPS signal is at HIGH at both the leading edge and the trailing edge of the CAS signal. It is also preferable that the specific cylinder is a second cylinder and the predetermined position is top dead center.

The determining if the engine is rotating in reverse comprises detecting the level of the CPS signal at the leading edges and falling edges of the CAS signal after it is determined that the piston in the specific cylinder is at the predetermined position, storing the CPS signal levels as a binary number, in which a 1 is stored if the CPS signal level is HIGH and a 0 is stored if the CPS signal level is LOW, and determining that the engine is rotating in reverse if the stored binary number is identical to a predetermined number.

In another preferred embodiment of the present invention, a system for preventing reverse rotation operation of an engine comprises a crank angle sensor (CAS) for detecting a rotating angle of a crankshaft, a cam position sensor (CPS) for detecting a position of a camshaft, and an engine control unit receiving signals from the CAS and the CPS to perform engine control to prevent the reverse rotation operation of the engine. The engine control unit is programmed to perform control steps comprising determining if a piston in a specific cylinder is at a predetermined location using the level of the CPS signal at a leading edge and a trailing edge of the CAS signal, determining if the engine is rotating in reverse using the CPS signal level at the leading edge and trailing edge of the CAS signal in the case where it is determined that the piston of the specific cylinder is at the predetermined location, and discontinuing operation of the engine if it is determined that the engine is undergoing reverse rotation.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Preferred embodiments of the present invention will now be described in detail with reference to the accompanying drawings.

Figure 1:
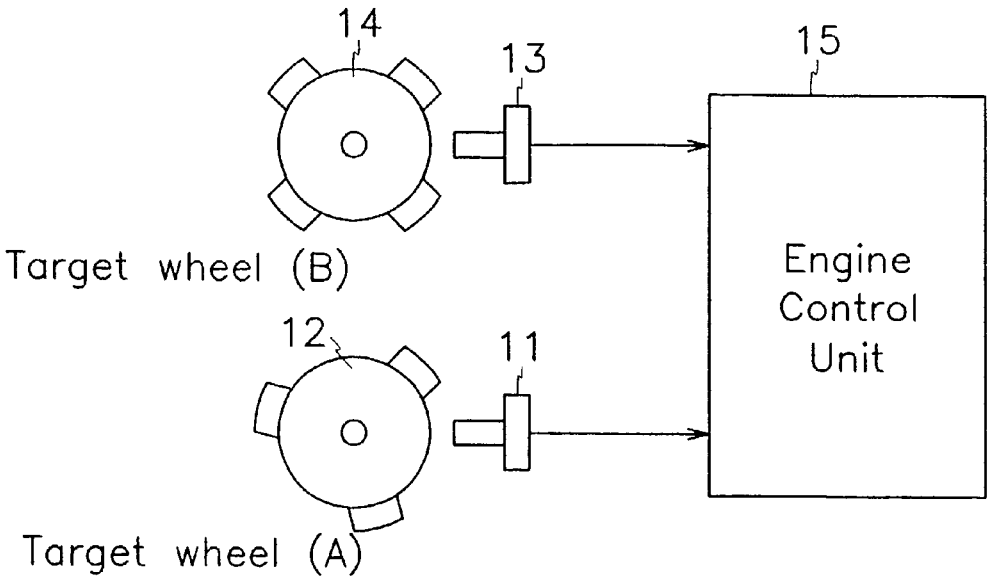
FIG. 1 is a schematic diagram of a system for performing engine operation determination and cylinder mode determination.

With reference to FIG. 1, in an engine rpm detection and cylinder operation determination system, to perform engine operation detection and cylinder operation determination, a crank angle sensor (CAS) 11 is mounted at a location for signal detection of target wheel (A) 12, which is mounted on an engine crankshaft. The CAS 11 outputs a signal representative of the crankshaft angle to an engine control unit 15. Further, a cam position sensor (CPS) 13 is mounted at a location for signal detection of target wheel (B) 14, which is mounted on a camshaft. The CPS 13 outputs a signal representative of the camshaft position to the engine control unit 15. Control unit 15 preferably includes a processor, memory and other necessary hardware and software components as will be understood by persons skilled in the art to permit the control unit to communicate with sensors and execute the control function as described herein.

Figure 2:
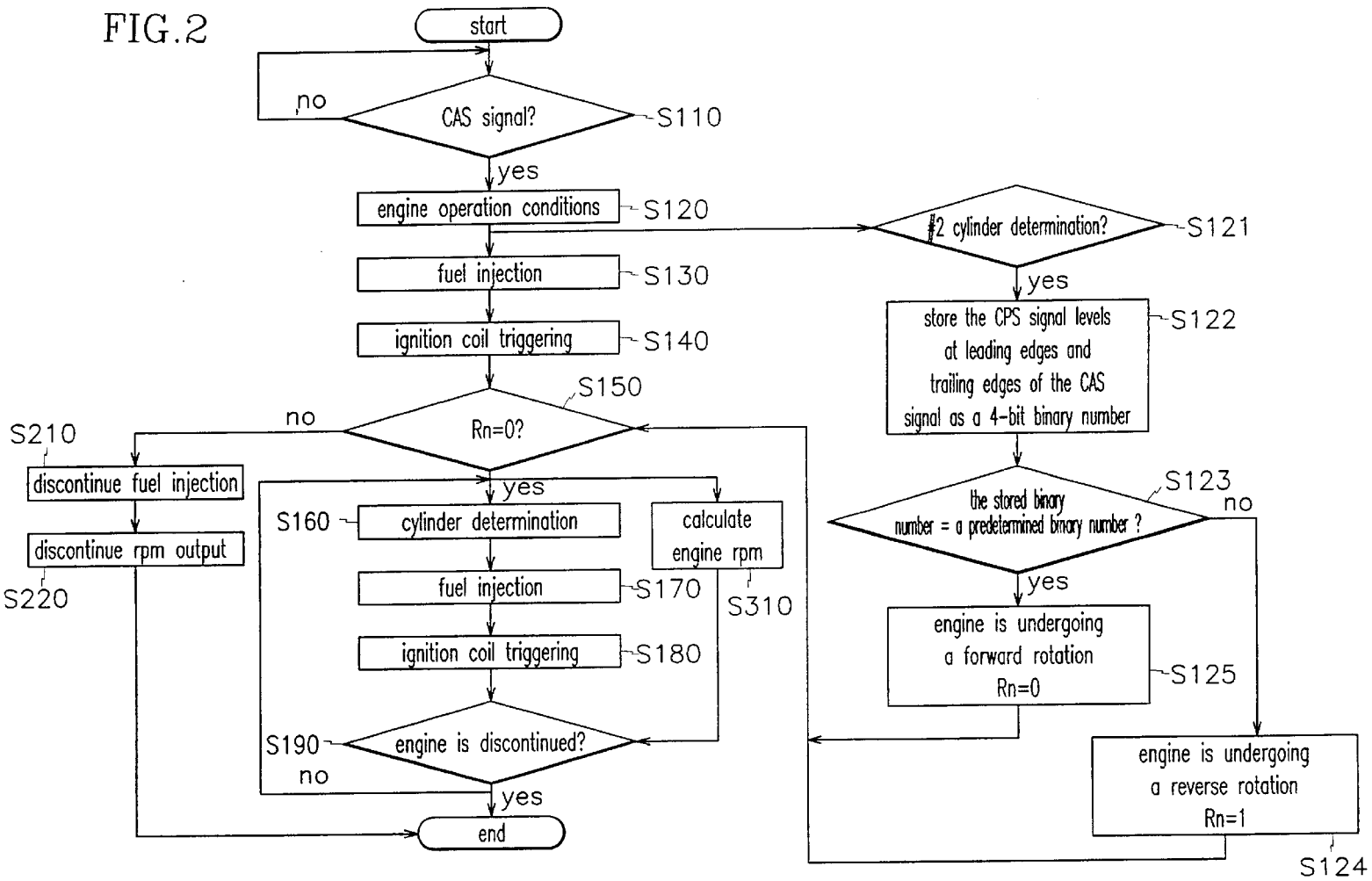
FIG. 2 is a flow chart of a method for preventing reverse rotation operation of an engine according to a preferred embodiment of the present invention.

In a method for preventing reverse rotation operation of an engine according to a preferred embodiment of the present invention, the CAS and CPS signals are used to detect reverse rotation of an engine, and if it is determined that the engine is undergoing reverse rotation, fuel injection and rpm output are prevented from occurring. This method will be described in more detail below with reference to FIG. 2.

First, it is determined whether a CAS signal is being input in step S110. If a CAS signal is being input, engine operation conditions are determined in step S120. Next, during engine operation, fuel injection is performed in step S130 and an ignition coil is operated in step S140.

Subsequently, it is determined if an engine rotation determination number Rn is 0 in step S150. The engine rotation determination number Rn indicates whether the engine is rotating in a forward or a reverse direction. A value of 0 for the engine rotation determination number Rn indicates that the engine is rotating in a forward direction, while a value of 1 for the engine rotation determination number Rn indicates that the engine is rotating in a reverse direction. Preferably, the engine rotation determination number Rn is initialized to 0.

Processes for determining whether the engine is rotating reversibly are performed following step S120 and at the same time as steps S130 and S140. In more detail, it is first determined if a second cylinder is operating in a predetermined mode in step S121. That is, it is determined if a piston in the second cylinder is at a predetermined position therein. In the preferred embodiment of the present invention, the predetermined position is top dead center.

The determination of whether the second cylinder is operating in the predetermined mode will also be described with reference to FIG. 3. The CAS signal and the CPS signal are compared using the same time of reference, and a level of the CPS signal is determined at a leading edge and a trailing edge of the CAS signal. If the CPS signal is at HIGH at both the leading edge and trailing edge of the CAS signal, it is determined that the piston in the second cylinder is close to its top dead center position.

After performing step S121 of determining whether the second cylinder is operating in the predetermined mode, the level of the CPS signal is detected for four more leading and trailing edges of the CAS signal (two of each, alternately), then these levels are stored as a 4-bit binary number in step S122. That is, starting with the least significant bit of the binary number, if the CPS signal is HIGH, a 1 is stored, and if the CPS signal is LOW, a 0 is stored.

Figure 4:
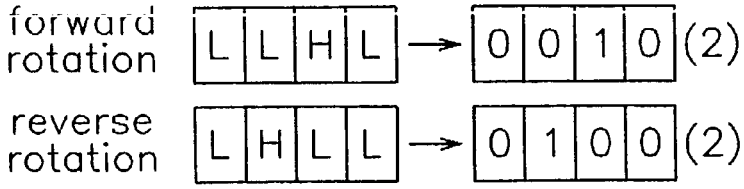
FIG. 4 is a chart used to describe operations of cylinder mode determination during forward and reverse rotation and obtaining calculation values according to a preferred embodiment of the present invention.
Figure 3:
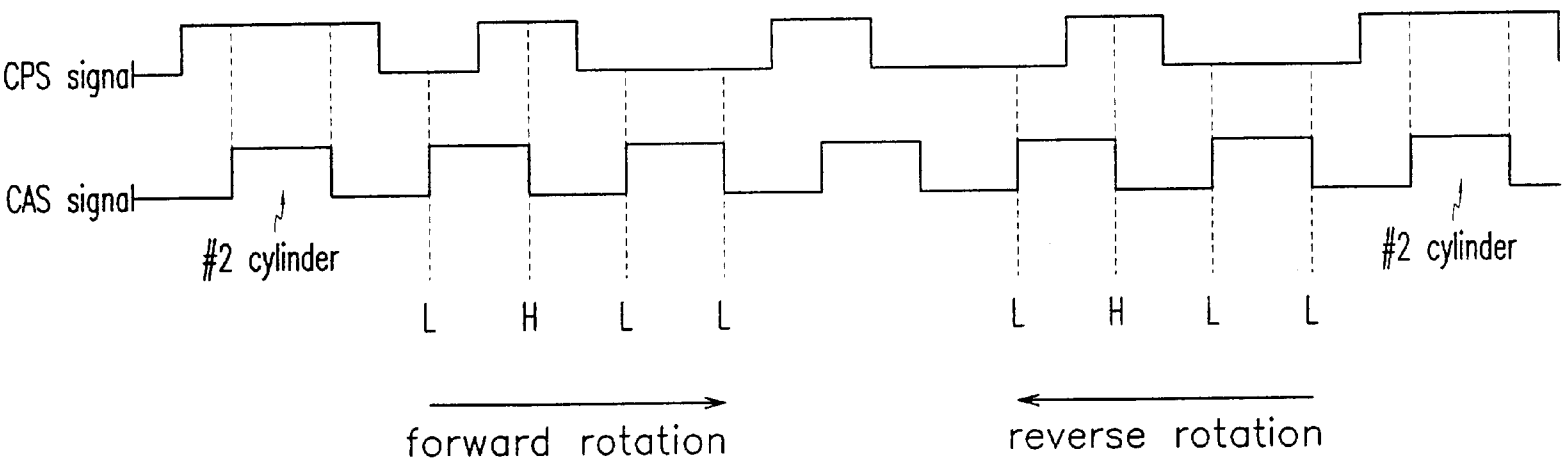
FIG. 3 is a timing diagram of CAS and CPS signals according to a preferred embodiment of the present invention.

As shown in FIGS. 3 and 4, after performing determination of the predetermined mode of operation for the second cylinder, if the engine is undergoing forward rotation, the CPS signal levels at four more leading and trailing edges of the CAS signal are LOW, HIGH, LOW, and LOW. Therefore, the binary number $0010_{(2)}$ is stored. If the engine is undergoing reverse rotation, the CPS signal levels at four successive leading and trailing edges of the CAS signal are LOW, LOW, HIGH, and LOW to result in a stored binary number of $0100_{(2)}$.

Following step S122, the stored binary number is compared with the predetermined binary number $0100_{(2)}$. If the two numbers are identical, it is determined that the engine is rotating in reverse, while if the two numbers are different, it is determined that the engine is undergoing forward rotation in step S123.

Although the preferred embodiment of the present invention has been described above, it is to be assumed that determinations of whether the engine is rotating reversibly may be made even with different initial setting states of target wheel (A) 12 mounted to a crankshaft and target wheel (B) 14 mounted to a camshaft.

If it is determined that the engine is undergoing forward rotation in step S123, a 0 is stored as the engine rotation determination number Rn in step S124, while if it is determined that the engine is undergoing reverse rotation in step S123, a 1 is stored as the engine rotation determination number Rn in step S125. The process is returned to step S150 after step S125.

As described above, it is determined in step S150 whether the engine rotation determination number Rn is 0. If the engine rotation determination number Rn is 0, cylinder operation in the predetermined mode is determined in step S160. Next, fuel injection is performed in step S170 and the ignition coil is triggered is step S180. Subsequently, it is determined if operation of the engine is stopped in step S190. If the operation of the engine is stopped, the process is ended. On the other hand, if the engine is not stopped, the process is returned to step S160.

In step S150, if it is determined that the engine rotation determination number Rn is not 0, fuel injection is discontinued in step S210 and rpm output is discontinued in step S220, after which the process is ended. Also, following a positive determination in step S150 that the engine rotation determination number Rn is 0, the calculation of engine rpm in step S310 is performed simultaneously with steps S160, S170, and S180.

In preferred methods of the present invention for preventing reverse rotation operation of the engine described above, detection of the reverse rotation of the engine is performed. That is, when starting from a stopped state on a hill, the present invention detects the reverse rotation of the engine occurring as a result of the delayed operation of the accelerator pedal by the driver (or slow depressing of the accelerator pedal and releasing of the clutch pedal in a vehicle with a manual transmission) upon brake release, or occurring naturally as a result of the weight of the vehicle. If it is determined that the engine is rotating reversibly, fuel injection is cut off and rpm output is prevented, thereby improving safety and preventing mis-diagnosis of malfunctions by the engine control unit.

The CAS and CPS signals received from the target wheels mounted to the crankshaft and the camshaft are respectively generally used to determine engine operation, cylinder mode operation, and engine rpm. In the present invention, these two signals are also used to determine if the engine is rotating in a forward or reverse direction, and when it is determined that the engine is undergoing forward rotation, normal logic is applied. Further, since the CAS and CPS signals are engine hardware-related signals, the synchronization of the signals is not altered. Also, by discontinuing fuel injection and engine rpm output when it is determined that the engine is undergoing reverse rotation, using the CAS and CPS signals, damage to the engine is prevented.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A method for preventing reverse rotation operation of an engine, comprising:

sensing engine crank angle and generating a CAS signal representative thereof;

sensing engine cam position and generating a CPS signal representative thereof;

determining if a piston in a specific cylinder is at a predetermined location using a level of the CPS signal at a leading edge and a trailing edge of the CAS signal;

determining if the engine is rotating in reverse using the CPS signal level at the leading edge and trailing edge of the CAS signal in the case where it is determined that the piston of the specific cylinder is at the predetermined location; and discontinuing operation of the engine if it is determined that the engine is undergoing reverse rotation.

2. The method of claim 1 wherein it is determined that the piston in the specific cylinder is at the predetermined position if the level of the CPS signal is at HIGH at both the leading edge and the trailing edge of the CAS signal.

3. The method of claim 2, wherein the specific cylinder is a second cylinder and the predetermined position is top dead center.

4. The method of claim 3, wherein determining if the engine is rotating in reverse comprises:

detecting the level of the CPS signal at the leading edges and falling edges of the CAS signal after it is determined that the piston in the specific cylinder is at the predetermined position;

storing the CPS signal levels as a binary number, in which a 1 is stored if the CPS signal level is HIGH and a 0 is stored if the CPS signal level is LOW; and determining that the engine is rotating in reverse if the stored binary number is identical to a predetermined number.

5. A system for preventing reverse rotation operation of an engine comprising:

a crank angle sensor (CAS) cooperating with an engine crankshaft to detect a rotating angle of the crankshaft and generate a signal representative thereof;

a cam position sensor (CPS) cooperating with an engine camshaft to detect a position of the camshaft and generate a signal representative thereof; and an engine control unit receiving signals from the CAS and the CPS to perform engine control to prevent the reverse rotation operation of the engine, said engine control unit being programmed to execute steps comprising determining if a piston in a specific cylinder is at a predetermined location using a level of the CPS signal at a leading edge and a trailing edge of the CAS signal;

determining if the engine is rotating in reverse using the CPS signal level at the leading edge and trailing edge of the CAS signal in the case where it is determined that the piston of the specific cylinder is at the predetermined location; and discontinuing operation of the engine if it is determined that the engine is undergoing reverse rotation.

* * * * *